US010196250B2

(12) United States Patent
Randall

(10) Patent No.: US 10,196,250 B2
(45) Date of Patent: Feb. 5, 2019

(54) BI-POD RESCUE STRUT SYSTEM

(71) Applicant: Red Rescue, LLC, Renton, WA (US)

(72) Inventor: Steven Randall, Renton, WA (US)

(73) Assignee: Red Rescue, LLC, Renton, WA (US)

( * ) Notice: Subject to any disclaimer, the term of this patent is extended or adjusted under 35 U.S.C. 154(b) by 0 days.

(21) Appl. No.: 15/908,751

(22) Filed: Feb. 28, 2018

(65) Prior Publication Data

US 2018/0186615 A1 Jul. 5, 2018

Related U.S. Application Data

(63) Continuation-in-part of application No. 15/627,316, filed on Jun. 19, 2017, now Pat. No. 9,938,125.

(60) Provisional application No. 62/352,092, filed on Jun. 20, 2016.

(51) Int. Cl.

| | |
|---|---|
| ***B66F 3/18*** | (2006.01) |
| ***B66F 13/00*** | (2006.01) |
| ***A62B 99/00*** | (2009.01) |

(52) U.S. Cl.

CPC ..... *B66F 13/00* (2013.01); *A62B 99/00* (2013.01)

(58) Field of Classification Search

CPC ..... B66F 1/00; B66F 3/00; B66F 5/00; B66F 7/00

See application file for complete search history.

(56) References Cited

U.S. PATENT DOCUMENTS

| | | | | |
|---|---|---|---|---|
| 5,876,011 | A * | 3/1999 | Blasing | F16M 11/28 248/170 |
| 8,672,298 | B2 * | 3/2014 | Hsieh | B60S 9/08 254/418 |
| 9,938,125 | B2 * | 4/2018 | Randall | B66F 13/00 |
| 2005/0263670 | A1 * | 12/2005 | Pasto | A62B 3/005 248/676 |
| 2013/0087749 | A1 * | 4/2013 | Hsieh | B60S 9/08 254/100 |
| 2017/0253470 | A1 * | 9/2017 | Jones | B66F 1/02 |
| 2017/0362069 | A1 * | 12/2017 | Randall | B66F 13/00 |

* cited by examiner

*Primary Examiner* — Lee D Wilson
(74) *Attorney, Agent, or Firm* — Cozen O'Connor

(57) ABSTRACT

Embodiments in the present description are provided for a Bi-pod rescue strut system for use in stabilizing a vehicle or other object. The Bi-pod rescue strut system includes stabilizing feet and support legs. Each of the stabilizing feet is pivotally connected to an end of each support leg so that the stabilizing feet rotate around the support legs. The Bi-pod rescue strut system further includes a yoke disposed at an end of the support legs. The yoke permits the support legs to extend and retract towards or away from the other support leg. The yoke connecting to a telescoping strut extension. The telescopic strut extension extending and coming into contact with vehicle or other object, stabilizing the vehicle or other object.

18 Claims, 12 Drawing Sheets

BI-POD RESCUE STRUT SYSTEM

CROSS REFERENCE TO RELATED APPLICATION

This application is a continuation in part of U.S. patent application Ser. No. 15/627,316 filed on Jun. 19, 2017 which claims priority to a prior-filed provisional application Ser. No. 62/352,092, filed on Jun. 20, 2016.

FIELD OF DISCLOSURE

The field of disclosure is generally directed to a portable bracing and support system. More particularly, the invention is directed to an adjustable, telescopic Bi-pod rescue strut system, suitable for use in stabilizing and lifting a vehicle or other object at the scene of an accident or emergency setting.

BACKGROUND

Following an accident, a vehicle may come to rest on its side, its roof, or against another object such as a tree. It may become necessary to not only stabilize the vehicle in its resting position to prevent further damage to the occupants in the vehicle or to the vehicle itself but also to create a work area that is safe for First Responders operating inside or around the vehicle or object while providing emergency rescue or providing support in an emergency setting. In the past it was easier to stabilize vehicles because the vehicles' surfaces were mostly flat and made of steel, only requiring a few wedges to stabilize the vehicle. Newer vehicles however have more rounded bodies and are made of thin layers of steel or have plastic panels, which can cause the vehicle to act unpredictably when the vehicle rolls over or is knocked off its wheels.

With instability in newer cars it becomes necessary to provide a stabilization system that is adjustable to accommodate for various positions, heights, angles and types of cars. It is also important for First Responders to utilize a Bi-pod rescue strut system that is portable so that it may be transported easily to any emergency scene and occupy less space while being transported in their vehicle. This would give First Responders ample space for other tools important to an emergency setting. The Bi-pod rescue strut system should also have multiple configurations and applications so that multiple tools are not needed, further maximizing space for the First Responder's vehicle. Having multiple applications also leads to decreasing the need for extensive training to learn how to operate multiple devices. The Bi-pod rescue strut system should also be able to be quickly assembled because any extra time used in constructing a stabilization system could be used to help the victims. Currently most popular methods of stabilizing a vehicle are to use wooden beams and rescue struts.

First Responders use wooden beams such as four by four beams where the First Responders wedge the wooden beams between the ground or other stable surface and a part of the vehicle that needs to be supported. This method can prove quite burdensome because the wooden beams usually are discarded after one use, thus requiring a new set of beams. The wooden beams also cannot be dissembled or collapsed, decreasing the portability aspect of the system. The wooden beams also occupy an excessive amount of space in a First Responder's vehicle, taking up space for other important tools that are crucial to an emergency setting.

Struts are also typically used by First Responders. Struts are columns that are tipped over with their top surface anchored against the vehicle. A strap or other device connected to the strut is used to pull the base of the strut towards the car, helping to apply a uniform force to the vehicle in a vertical and horizontal direction. Struts may also function as tripods for confined space applications whereby a tripod head receives the top surfaces of three struts and is then used over a confined space hole. A winch connected to the tripod is then used to raise or lower a person or equipment.

Some problems commonly found in struts such as these are that the systems are heavy, expensive, cumbersome and difficult to transport as well as to initially erect. Also a single strut provides only one column or support leg to support the vehicle, extending from the base of the strut to the upper extension tube member. The narrower the base sitting on the ground the easier it is to tip the strut over. Further it is harder for struts to be used as an anchorage connector for confined space and rescue applications in a tripod configuration due to obstructions or minimal space on either of the confined space entry point.

SUMMARY

According to one embodiment, a rescue strut device for use in stabilizing a vehicle or other objects, including: one or more stabilizing feet, one or more support legs, wherein one of each of the stabilizing feet is attached to a first end of each support leg; a yoke disposed at the second end of each support leg, wherein each support leg is connected to the yoke at the second end of each support leg, such that each support leg is extendable and retractable towards or away from the other support legs, whereby each of the support legs has an engagement hole at an angle through a lateral end of each support leg, whereby when the support legs are rotated at an angle in relation to the yoke, the engagement holes in each of the support legs align with an engagement hole in the yoke, permitting a pin to be placed through the engagement holes in each of the support legs and through the engagement hole the yoke, securing the support legs at the in relation to the yoke, and a telescoping strut extension, wherein the telescoping strut extension has a lower member the lower member connected to the yoke, the lower member in slidable engagement with one or more upper extendable members.

According to one embodiment, a stand for confined space and remote rescues including a first and second rescue strut; the first and second rescue strut and stabilization device comprising; one or more stabilizing feet; one or more support legs, wherein one of each of the stabilizing feet is attached to a first end of each support leg; a yoke disposed at the second end of each support leg, wherein each support leg is connected to the yoke at the second end of each support leg, such that each support leg is extendable and retractable towards or away from the other support legs, and a telescoping strut extension, wherein the telescoping strut extension has a lower member the lower member connected to the yoke, the lower member in slidable engagement with one or more upper extendable members, the upper extendable members having a second end; and a body coupled for receiving the second end of the upper extendable members of the first and second rescue strut.

According to one embodiment, a method of using a Bi-pod rescue strut system for use in lifting a vehicle or other object, the method comprising: producing a Bi-pod rescue strut system, the Bi-pod rescue strut system comprising: one or more stabilizing feet; one or more support legs having a first end and second end, wherein one of each of the one or more stabilizing feet is attached to a first end of the support legs; a yoke disposed at the second end of each support leg, wherein each support leg is connected to the yoke at the second end of each support leg, such that each support leg is extendable and retractable towards or away from the other support legs; wherein each of the support legs has an engagement hole at an angle through the support legs, wherein when each of the support legs are rotated at an angle in relation to the yoke, the engagement holes in each of the support legs align with an engagement hole in the yoke, permitting a pin to be placed through the engagement holes in each of the support legs and through the hole in the yoke, securing each of the support legs in relation to the yoke; connecting a link the yoke, the link in a first position; connecting a lever to the link, the lever connected to and balancing on a fulcrum; positioning the support legs beneath the vehicle or other object; applying a force to an end of the lever, causing the support legs on the lifting device to make contact with an underside of the vehicle or other object and lift the vehicle or other object to a first height, wherein the vehicle or other object is stabilized by a step chock or apparatus.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
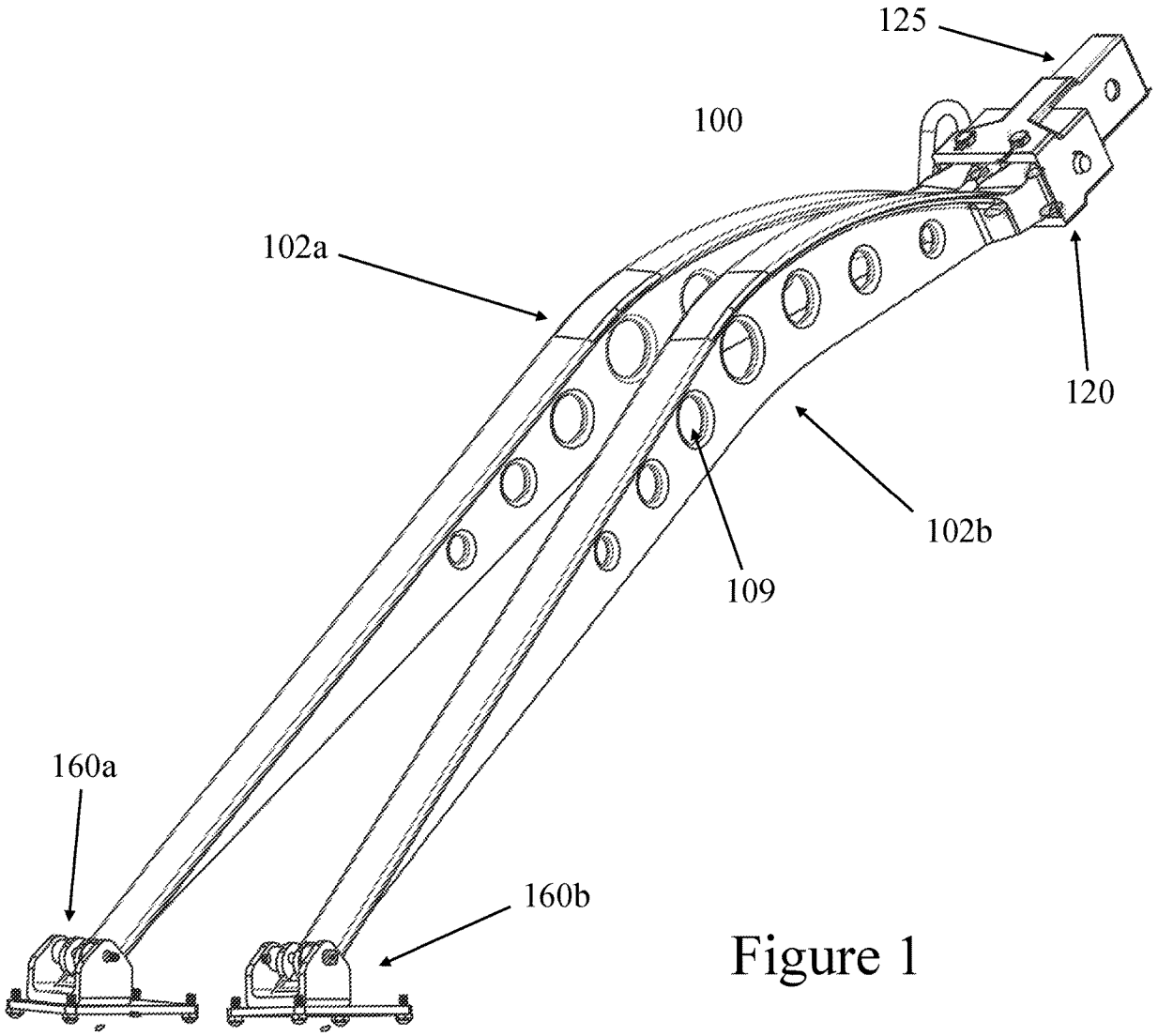
FIG. 1 illustrates a perspective view of an embodiment of a Bi-pod Rescue Strut System.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure recognizes the unsolved need for a Bi-pod rescue strut system that may be used quickly and conveniently to rapidly and safely stabilize a vehicle or other object at the scene of an accident or other emergency setting, particularly during emergency rescue operations where rescue workers need to secure the vehicle or other object with the use of a telescopic Bi-pod rescue strut system to stabilize the vehicle or other object as well as safely remove occupants from within or under the vehicle or other object. The Bi-pod rescue strut system may also be used as a lifting device for lifting a vehicle or other object.

Existing systems and methods for rescue devices are not as secure, usually only providing a narrow base that can easily be tipped over and also require an extensive amount of time to install. They also are expensive, occupy too much space, are dangerous for the First Responder to operate and monitor. The present invention provides a multi-legged, portable, adjustable, extendable Bi-pod rescue strut system utilized for emergency and rescue operations, providing multiple features and configurations including operating as a "quad-pod" for loads applied above and below the Bi-pod rescue strut system, a support column, a lifting device for lifting a vehicle or other object, and many other useful features and utilities.

These multiple uses allow the Bi-pod rescue strut system to be stored in a small package, allowing more space for more tools such as airbags or multiple struts. The Bi-pod rescue strut system also prevents extensive training because of its ease and familiarity. The Bi-pod rescue strut system also provides a better position for First Responders to tighten the Bi-pod rescue strut system where they may stand instead of kneel, and provides for a better position to monitor and run away if the vehicle or object starts to fall or topple over. The mechanical advantage and load sharing of the Bi-pod rescue strut system create an easier stronger system that is easier to secure and lift if needed.

The Bi-pod rescue strut system, as depicted in FIG. 1, may include, in one or more embodiments, a left support leg and right support leg such as left support leg 102*a* and right support leg 102*b*. Support legs 102*a* 102*b* may be curved or curvilinear, elongated members. The curved elongated shape acts as a strong structural support for the stabilization of a load or object.

Support legs 102*a* 102*b* have a top surface and a bottom surface as well as a proximal end and distal end. In one or more embodiments, bottom surface may be straight and flat. Alternatively, or additionally, bottom surface of each one of support legs 102*a* 102*b* may also be angled or curved.

Support legs 102*a* 102*b* may each have an upwardly tapering portion. Further, support legs 102*a* 102*b* may each have a downwardly tapering portion. In one or more embodiments, a body of the left support leg 102*a* is designed to be substantially the same or identical as the body of right support leg 102*b*. Thus, both support legs 102*a* 102*b* may have a curved shape. However in one or more non-limiting embodiments, support legs may be designed to be straight and flat.

Support legs 102*a* 102*b* may have the same general appearance. However, it is noted that support legs may be any size or shape as desired. In one or more implementations, support legs may taper upwardly to a flat support surface. At the distal end of flat support surface, the downwardly tapering portions of support legs may begin. Flat support surface may have a uniform height or may increase or decrease in other configurations. Notably, support legs are designed to curve upwardly and then to curve downwardly.

In one or more embodiments, holes or cavities such as holes 109 are disposed throughout support legs 102*a* 102*b* may function to reduce the weight of Bi-pod rescue strut system 100 as well as to assist in maintaining the strength of the Bi-pod rescue strut system 100. Further, it is noted, that the holes or cavities that extend through a thickness of support legs may be omitted in alternative designs or vary in number and size and spacing.

Figure 2:
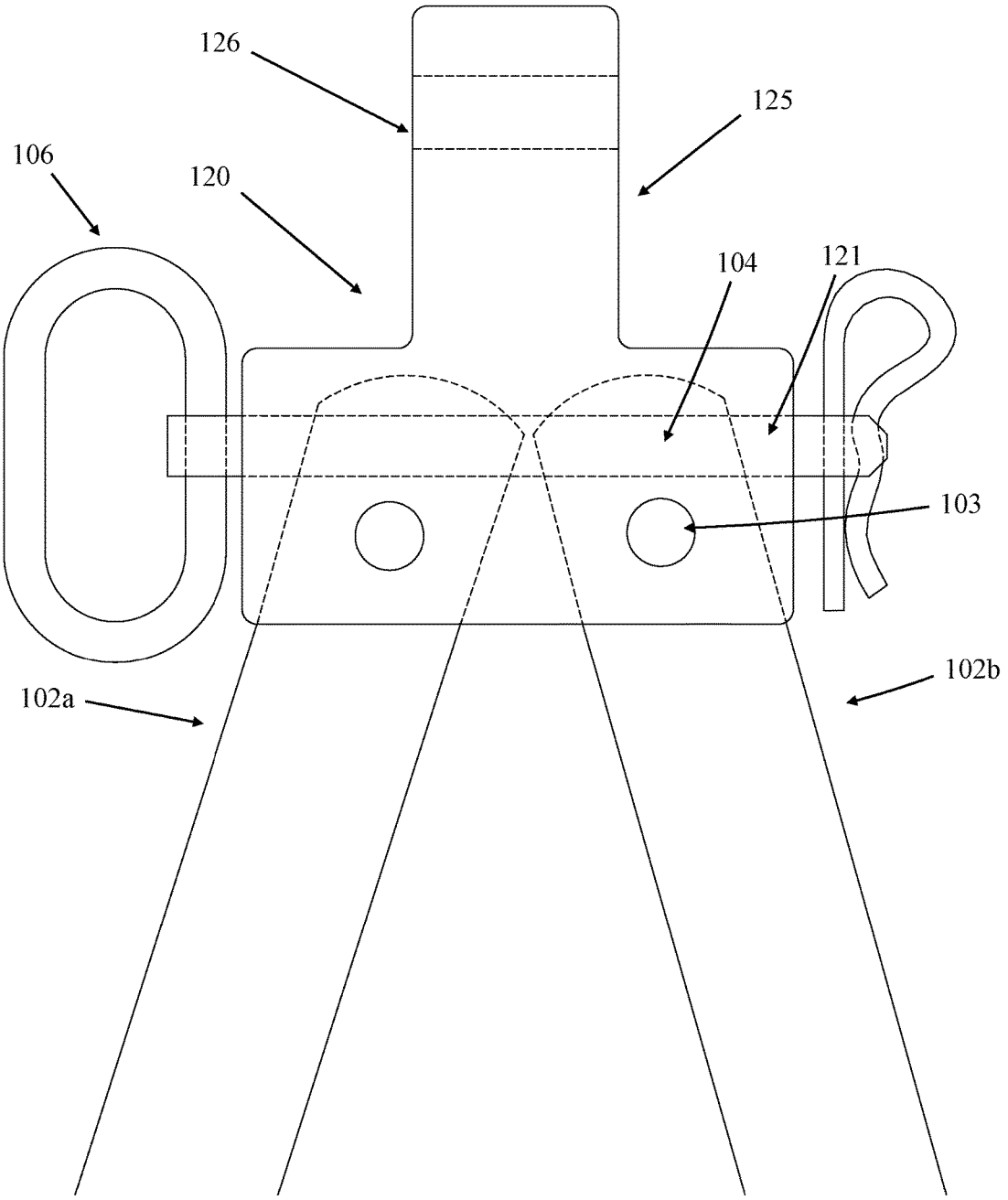
FIG. 2 illustrates a front view of the yoke and support legs of the Bi-pod Rescue Strut System in the open position.

Support legs 102*a* 102*b* are adapted to either move jointly or independently of each other, and may be positioned in a variety of ways. For instance, support legs 102*a* 102*b* when connected to a yoke such as yoke 120, as depicted in FIG. 2, may be moveable towards and away from each other so as to be spread apart. Further, support legs 102*a* 102*b* may be brought close together so as to be in a straight parallel alignment with each other. Alternatively, or additionally, support legs 102*a* 102*b* may be configured so that each support leg moves independently of the other such that each support leg may be disposed at a desired angle.

Figure 3:
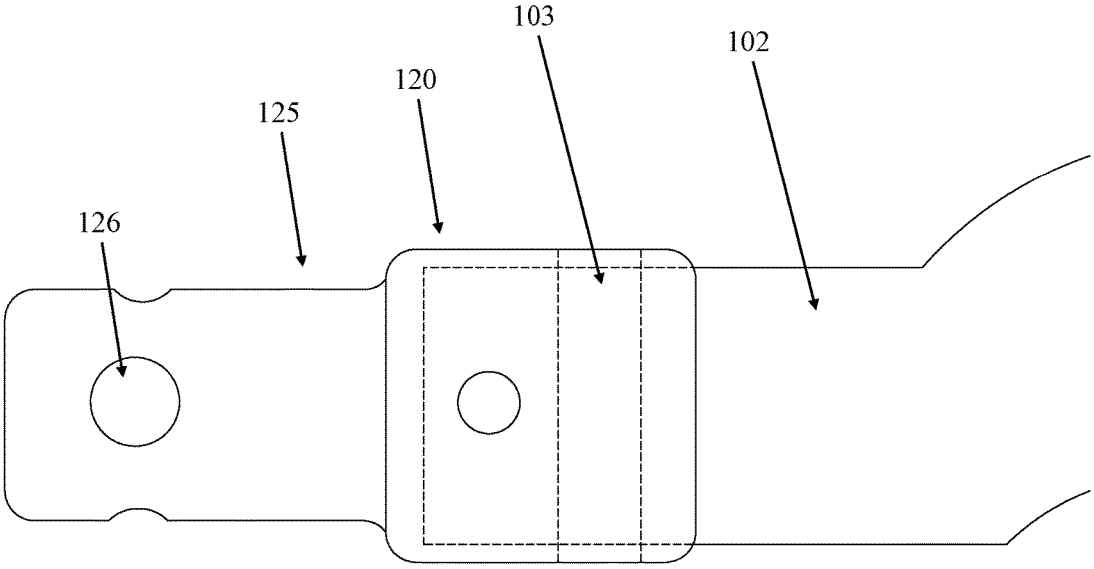
FIG. 3 illustrates a side view of the yoke and support legs of the Bi-pod Rescue Strut System.

Near the proximal ends of support legs 102*a* 102*b*, adjacent to where yoke 120 may be coupled to each support leg 102*a* 102*b*, there may be one or more pivot holes such as pivot hole 103, as depicted in FIG. 3, that extends through support legs 102*a* 102*b* and yoke 120 whereby one or more fasteners may secure support legs 102*a* 102*b* to yoke 120, creating a pivot point for support legs 102*a* 102*b* relative to yoke 120.

Near the proximal ends of support legs 102*a* 102*b*, there may also be one or more locking holes such as locking holes 104 that extend through support legs 102*a* 102*b* at an angle through the sides on the surface perpendicular to surface of support legs 102*a* 102*b* that pivot holes 103 pass through, such that a position-locking pin such as position-locking pin 106, may be extended through locking holes 104 in support legs 102*a* 102*b*, locking support legs at an angle relative to yoke 120. Locking hole's 104 angle is preferably a 45 degrees angle but may vary based on the specific needs of the emergency rescue situation.

In one or more embodiments, support legs are essentially formed as a single solid beam structure. In some embodiments, support legs may be integrally formed as a single whole piece. Alternatively, in other embodiments, support legs may be formed as an assembly of separate structural pieces. In one or more embodiments, support legs may be formed as a modified I-beam structure. In alternative embodiments, a body of support legs may include double beams, triple beams, or any number of beams as needed. Accordingly, in one or more embodiments, support legs may each include an upper beam coupled to a lower beam that makes up the body of each one of support legs. Having the upper beam coupled to the lower beam for each one of support legs may add strength and additional structural stability to rescue strut device.

Figure 4:
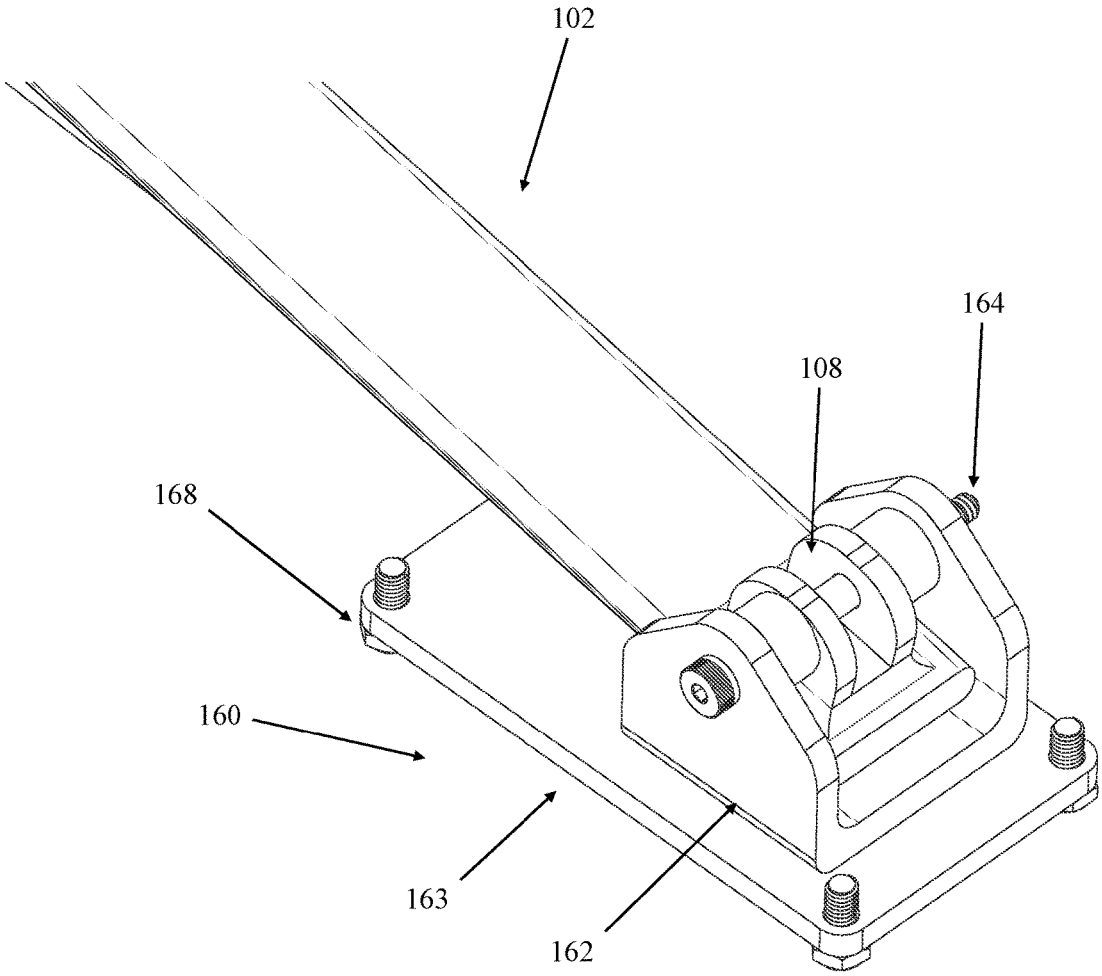
FIG. 4 illustrates a perspective view of the stabilizing feet of the Bi-pod Rescue Strut System rotated in one direction.

In one or more embodiments, Bi-pod rescue strut system 100 may further include a left stabilizing foot and right stabilizing foot such as left stabilizing foot 160*a* and right stabilizing foot 160*b* disposed at a distal end of the left support leg 102*a* and right support leg 102*b* respectively, as depicted in FIG. 4. Left stabilizing foot 160*a* and right stabilizing foot 160*b* each having a "U" shaped mounting bracket such as "U" shaped mounting bracket 162 having a forked head appearance with a base and a first member and second member that extend substantially parallel to the axis of rotation of the base. The first member and second member are equally spaced around a centerline axis of the base, providing an "ear" shaped design to the base plate. "U" shaped mounting bracket 162 may be connected to a base plate such as base plate 163 that has a rectangular shaped frame, although alternative shapes and configurations may certainly be used. In some embodiments, the "U" shaped mounting bracket and base plate may be one component.

The first member and second member of "U" shaped mounting bracket 162 of each stabilizing foot 160*a* 160*b* may include a hole extending through the lateral surface of the first and second members whereby the holes may be axially aligned with a hole through a barrel member such as barrel member 108 attached to support legs 102*a* 102*b* near or on the distal end of support legs 102*a* 102*b* whereby a fastener such as fastener 164 which may be a pivot screw, pulling pin, or other fastener may be placed through the hole of the first member and second member of "U" shaped mounting bracket 162 and the hole in barrel member 108 so that stabilizing feet 160*a* 160*b* are pivotally connected to barrel member 108 and thus support legs 102*a* 102*b*. In some embodiments, support legs may have a hole near or on the distal end of support legs whereby the hole is axially aligned with the hole in the first member and second member so that a fastener such as a pivot screw, pulling pin, or other fastener may pivotally connect the stabilizing feet to support legs.

Figure 5:
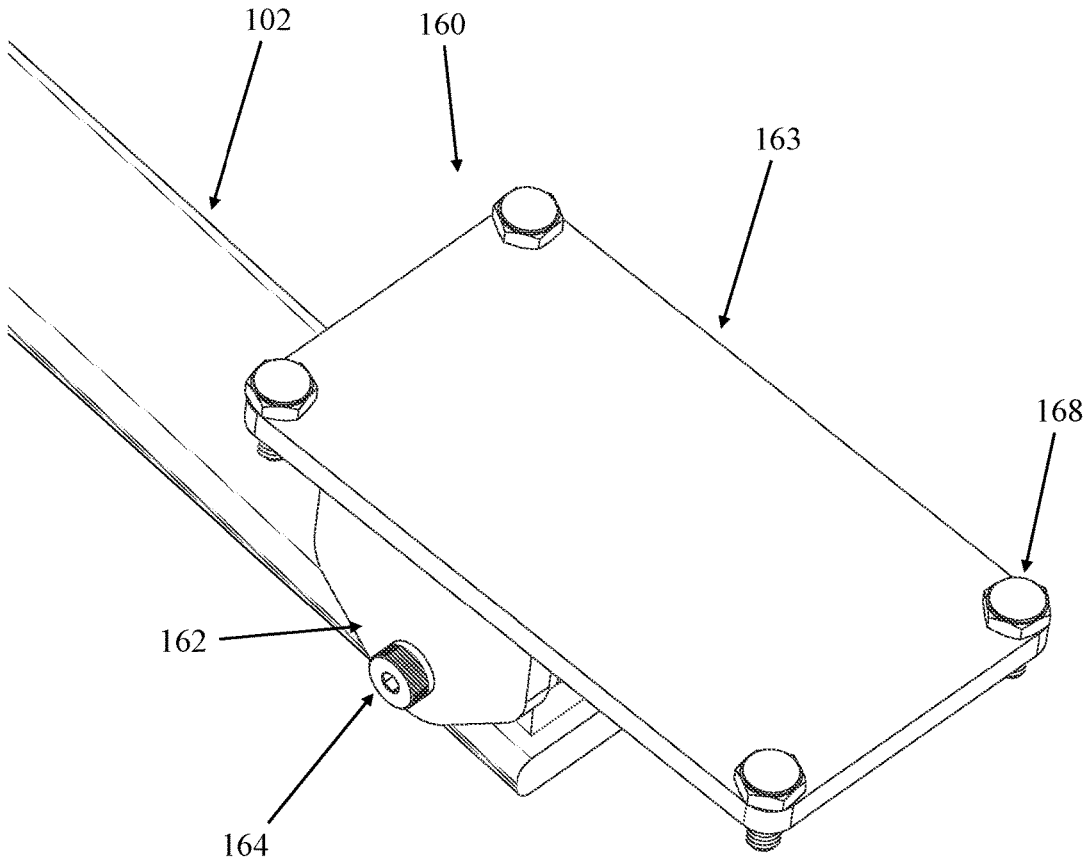
FIG. 5 illustrates a perspective view of the stabilizing feet of the Bi-pod Rescue Strut System rotated in the opposite direction from FIG. 4.

When fastened in a pivoting connection, stabilizing feet 160*a* 160*b* are rotatable around an axis transverse with respect to the axis of support legs 102*a* 102*b* so that "U" shaped mounting bracket 162 and base plate 163 may be swung to a first position on the side of the top surface of support legs 102*a* 102*b* to a second position 180 degrees from the first position on the side of the bottom surface of support legs 102*a* 102*b*, as depicted in FIG. 5. Support legs 102*a* 102*b* appear upside down or inverted when base plate 163 is positioned on the ground in the second position relative to when base plate 163 is positioned on the ground in the first position. "U" shaped mounting bracket 162 may also be orientated at any angle or position located between the first position and second position such as at a 90-degree angle relative to the first position where support legs 102*a* 102*b* is a vertical orientation perpendicular to base plate 163 whereby support legs 102*a* 102*b* are pointing directly upwards.

In some embodiments, the left stabilizing foot and right stabilizing foot may be locked at a specific angle relative to the left support leg and right support leg by a position-locking pin or other locking mechanisms known by those of ordinary skilled in the art whereby the left stabilizing foot and right stabilizing foot are maintained at a chosen angle relative to the left support leg and right support leg. In further non-limiting embodiments, the left stabilizing foot and right stabilizing foot may be locked at different angles for dissimilar terrain and conditions. The pivoting action of stabilizing feet 160*a* 160*b* with respect to the support legs 102*a* 102*b* increases the versatility of Bi-pod rescue strut system 100 by supporting loads at various angles including directly above Bi-pod rescue strut system 100. In other non-limiting embodiments, stabilizing feet may be coupled to a distal end of support legs using any affixation methods known in the art, including using any type of fasteners, adhesives or via welding or soldering, without limitation to these methods. In further embodiments, the left and right stabilizing feet may have one or more holes whereby a picket or other type rod may be driven into the ground through the holes in the left and right stabilizing feet to further prevent the Bi-pod rescue strut system from sliding.

Left stabilizing foot 160*a* and right stabilizing foot 160*b* may have the same general appearance. However, it is noted that left stabilizing foot 160*a* and right stabilizing foot 160*b* may be any size or shape as desired. Stabilizing feet 160*a* 160*b* may assist in stabilizing a load by preventing slippage of support legs 102*a* 102*b*, respectively, and provide additional grip for Bi-pod rescue strut system 100 to a ground surface. It is foreseeable that Bi-pod rescue strut system 100 may be used on a variety of terrains, including on terrains that may contribute to easy slippage of the Bi-pod rescue strut system 100 during actual use. The bottom side of the base plate of the stabilizing feet may comprise an additional gripping surface material or any adhesive wherein the material prevents slippage between the top platform and the base of the person's mandible.

The coverage area of the material may be an externally applied adhesive coating or the material may be impregnated within the top platform itself. The base plate itself may optionally have a rough or textured surface so as to increase friction and adherence to the body or surfaces without the need for additional layers or adhesives. Accordingly, Bi-pod rescue strut system may accommodate a variety of ground surfaces and terrains, including, but not limited to, muddy surfaces, rocky surfaces, snow, sand, pavement and/or dirt roads.

As previously described, stabilizing feet and may be attached at the end of support legs to contact the ground to minimize slippage. In some examples, optional attachments for different feet may accommodate different types of ground surface, such as dirt, mud, sand, and pavement. In some examples, stabilizing feet may be configured to rest on two by fours (2×4's) or four by fours (4×4's) to accommodate use on vehicles or other objects with higher ground clearance.

In further non-limiting embodiments, stabilizing feet 160*a* 160*b* may have holes or cavities for accepting coned ended studs such as studs 168 used to further grip the surface Bi-pod rescue strut system 100 is placed upon. Studs 168 may be maintained by lock nuts that may be tightened or removed so studs 168 may be replaced with newer studs after the previous become worn down. Studs may be of any shape and size including being in the shape of a cube, pyramid, prism, cylinder, or sphere.

Support legs 102*a* 102*b* provide additional other advantages in addition to providing grip to a ground surface and stabilization. For example, a strap, may be used in one or more applications to further stabilize Bi-pod rescue strut system 100 and may be attachable to each support leg 102*a* 102*b*, which will be discussed later. In some embodiments, support legs in the Bi-pod rescue strut system may not be curved, but may instead be formed as straight and flat support legs.

A yoke 120 may be coupled to the proximal ends of support legs 102*a* 102*b*. Yoke 120 includes an upper component 125 for receiving an attachment or other apparatus such as a telescopic strut member, and a lower component for housing and securing the proximal ends of support legs 102*a* 102*b*. Yoke 120 may be configured to have apertures therethrough whereby holes in yoke 120 may be aligned and coupled with one or more fasteners to pivot holes 103 at the proximal ends of support legs 102*a* 102*b* to secure support legs 102*a* 102*b* to yoke 120, creating a pivot point for support legs 102*a* 102*b* relative to yoke 120. Fasteners may be any type of fasteners known in the art, including, but not limited to, any type of screw and/or nut and bolt combination. The fasteners may be removed to detach support legs 102*a* 102*b* from yoke 120 so that a First Responder may carry and store the rescue strut and stabilization quicker and easier.

As noted above, support legs 102*a* 102*b* may be moveable, and may be moved within a particular range of movement so as to be spread apart from one another. The distance between support legs 102*a* 102*b* may be determined by a First Responder or other operator of Bi-pod rescue strut system 100. Because support legs 102*a* 102*b* are connectively joined, support legs 102*a* 102*b* are able to move to an open or closed position. It is noted that support legs 102*a* 102*b* may be opened as wide as desired by First Responder. Alternatively, support legs 102*a* 102*b* may be closed so as to be brought in alignment with each other. Alternatively, or additionally, each support leg 102*a* 102*b* may be independently moveable with respect to the other.

While support legs 102*a* 102*b* are secured to yoke 120, a First Responder may manipulate the positioning of support legs 102*a* 102*b* so that support legs 102*a* 102*b* may be closed and lie parallel to one another such that support legs 102*a* 102*b* are horizontally or vertically flat in the storage position for the facilitation of storage and transportation. Support legs 102*a* 102*b* may also be positioned at variable angles whereby support legs 102*a* 102*b* are spread in a rotary motion from each other at an angle around the axis of yoke 120 and may be placed on the ground for deployment and use. Bi-pod Rescue Strut System 100 may have lateral fastener such as lateral fastener 106 that secures through the passageway 121 of yoke 120 and passageway 104 through support legs 102*a* 102*b* to achieve a locked position at the desired angle. In further embodiments, the Bi-pod Rescue Strut System may have multiple vertical passageways in the yoke that correspond with the vertical leg passageway that will accommodate varied angles and combinations for angles. be locked in place relative to yoke to provide further stability to Bi-pod rescue strut system.

Figure 6:
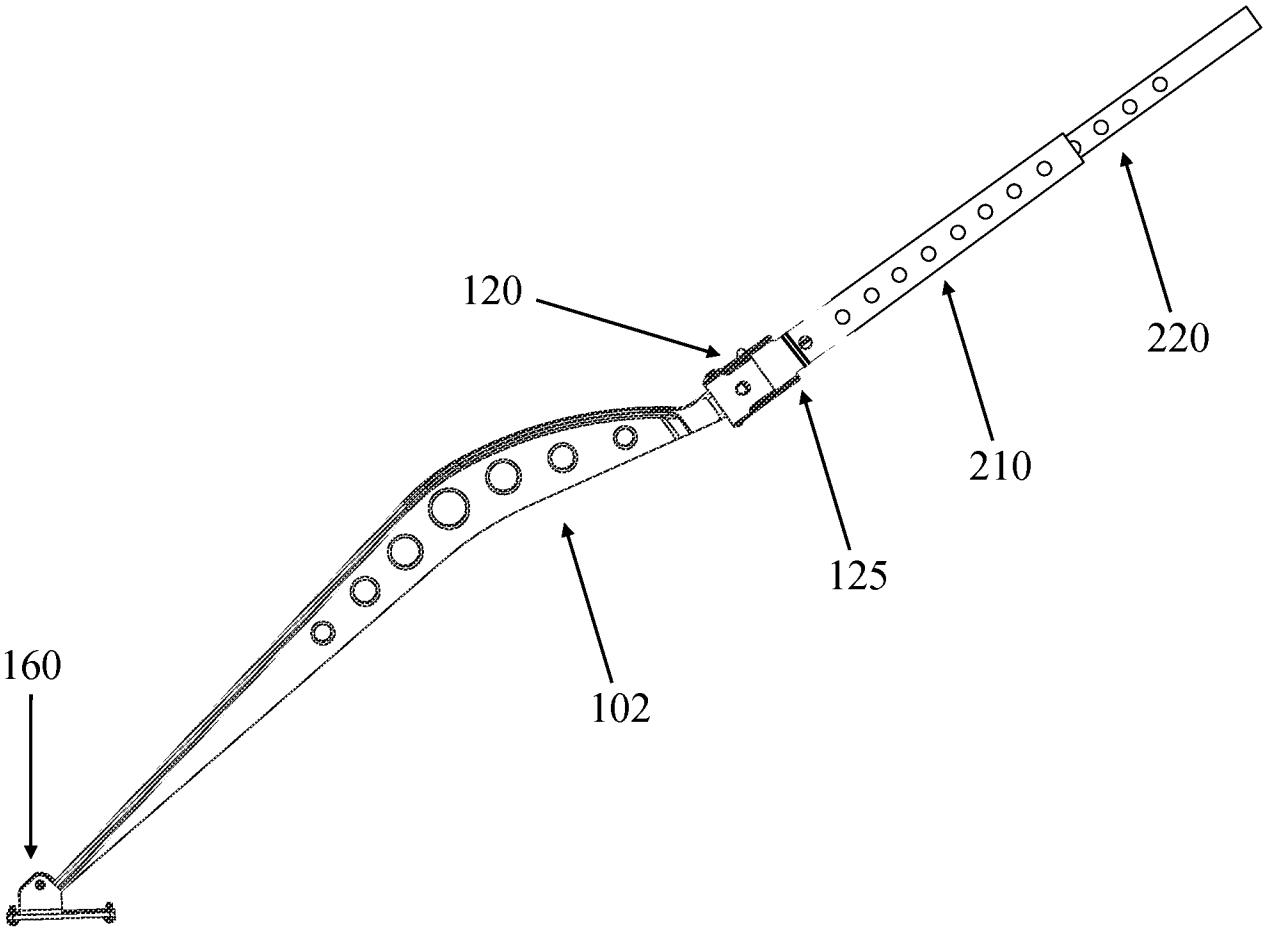
FIG. 6 illustrates a side view of the, telescopic strut extension yoke and support legs of the Bi-pod Rescue Strut System.

A telescopic strut extension such as telescopic strut extension 200 may be used in one or more applications to provide an attachment point on Bi-pod rescue strut system 100 to a load such as a vehicle positioned on its side as depicted in FIG. 6. Telescoping strut extension 200 has a lower outer tube member 210 in a slidable engagement with an extendable upper inner tube member 220 to extend the rescue strut for multiple heights to support loads at different distances.

Figure 7:
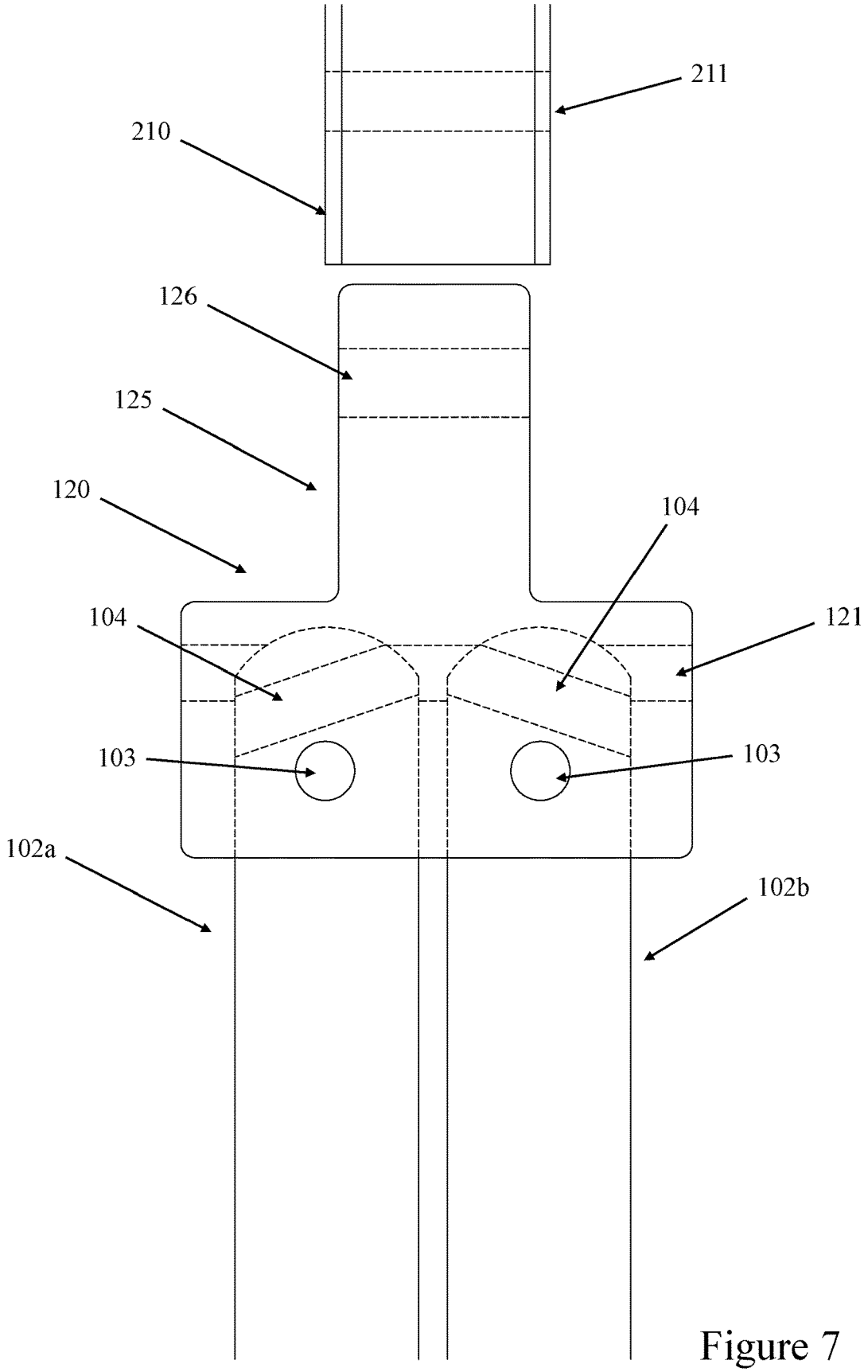
FIG. 7 illustrates a front view of the telescopic strut extension, yoke, and support legs of the Bi-pod Rescue Strut System in the closed position.

As seen in FIG. 7, lower outer tube member 210 is attached at its lower end to upper component 125 of yoke 120 with one or more fasteners whereby the fastener may be placed through a receiving hole such as receiving hole 126 of upper component 126 and a receiving hole such as receiving hole 211 through lower outer tube member 210. Fasteners may be any type of fasteners known in the art, including, but not limited to, any type of screw and/or nut and bolt combination. The fasteners may be removed to detach lower outer tube member 210 from upper component 125 of yoke 120, increasing portability of Bi-pod rescue strut system 100. Upper inner tube member 220 may have an end fitting affixed at its upper end for engaging and supporting the object to be stabilized such a vehicle positioned on its side or a ceiling.

Two-part telescopic strut extension 200 is shown having an upper inner tube member 220 and lower outer tube member 210, which generally is preferable due to simplicity and portability. However, a telescopic member may be added to upper extendable inner tube member 220 whereby upper inner tube member 200 is in a slidable engagement with a similarly structured additional extendable tube member to increase the length of the telescopic strut extension so that it may be applied to surfaces of a farther distance. In further embodiments, the additional tube member may be in a slidable engagement with similarly structured additional tube members to support loads at even a further distance. In some embodiments, the upper inner tube member may have greater area that the lower tube member and fit over and have a slidable engagement with the lower tube member.

Lower outer tube member 210 and upper extendable inner tube member 220 have a substantially rectangular uniform cross section. It is also noted that tube members may be any size or shape as desired. In one or more implementations, the tube members may be cylindrical in shape. Lower outer tube member 210 and upper extendable inner tube members 220 may also have grabs or other locking means for preventing unsafe over-extension of the members in relation to one another.

Telescopic strut extension 200 may include a position-locking pin to allow for the extension of upper inner tube member 220 in relation to lower outer tube member 210. In some embodiments, holes or are formed through the outer tube member 210 and inner tube member 220 and are of a certain distance from one another whereby the holes through lower outer tube member 210 align with corresponding holes on upper inner tube member 220 and a position-locking pin may be placed to lock the inner tube at a specific position in relation to lower outer tube member 210. Removing the position-locking pin allows for extension of upper inner tube member 220 whereby upper inner tube member 220 may freely move relative to lower outer tube member 210 in a linear telescopic motion. Replacing the position-locking pin in a hole in lower outer tube member 210 and upper inner tube member 220 locks upper inner tube member 220 at a specific position relative to lower outer tube member 210. In some non-limiting embodiments, the position-locking pin may be an instrument comprised of two or more pins whereby the pins may be entered simultaneously into aligned holes through the lower outer tube member and upper inner tube member at different heights further providing stability to the rescue strut.

Accordingly, in one or more embodiments, the components of the Bi-pod rescue strut system are made from a durable metal, such as steel, although alternative materials and/or elements may also be used such as aluminum, copper, titanium, brass, magnesium, fiberglass, gold, silver, graphite, ceramic, plastic, carbon fiber, wood, polymers, and other composites. Further, it is noted that any suitable manufacturing process may be used for forming the Bi-pod rescue strut system One or more straps may be used in one or more applications to further stabilize rescue strut and may be attachable to each support leg. Straps may be any type of strap known in the art. Straps may essentially be an elongated ribbon that is made of durable material. Straps include a first end and a second end. Straps may be made of any suitable material and/or fabric, including, but not limited to nylon. Strap may be a ratchet strap type with a self-sufficient recoiling mechanism for providing slack and tension to the strap. In alternative configurations a strong rope, chain, or other type of tying member may be used.

Straps may be used to provide additional stabilization for support legs of the Bi-pod rescue strut system, and help prevent support legs from moving during use. Straps may be hooked to another object or additional straps or tying members if the distance is too great to be reached by the strap. Chains or other tying members may be used to produce multiple connection points with an object such as a vehicle from the single strap.

One or more straps may be used in different locations and for different configurations. A load tension strap may be used to couple supports legs 102*a* 102*b* to the lower portion of a load that the upper inner tube member 220 of Bi-pod rescue strut system 100 is contact with such as a vehicle on its side. In one or more embodiments, a hook or other fastening apparatus may be affixed to the load tension strap. The load tension strap may be affixed to a chain whereby the chain may be wrapped around, passed through, hooked or otherwise securely affixed to the load. This prevents Bi-pod rescue strut system 100 from "kicking out" and further providing stability to the system.

A foot tension strap fastened near the distal ends of support legs 102*a* 102*b* may be used to couple support legs 102*a* 102*b* and provide tension between support legs 102*a* 102*b* so the support legs do not separate and spread apart from one another and assists in keeping support in the particular positions as desired by the First Responder. An extension tension strap may be used to couple upper inner tube member 220, whereby the strap is lead down along telescopic strut member 200, below yoke 120, and coupled to the load tension strap to distribute stresses evenly throughout the rescue strut and taking some of the burden of the stresses and load.

In the preferred method of use Bi-pod rescue strut system 100 in place a position ready for use whereby rescue strut affixed to and supporting a vehicle on its side. Support legs 102*a* 102*b* may be spread apart and locked in place in their deployed positions at a selected angle desired by the First Responder prior to using Bi-pod rescue strut system 100 to provide support to the vehicle. Stabilizing feet 160*a* 160*b* are also positioned so as to provide further grip on a ground surface on which vehicle is located upon.

Telescoping extension strut 200 is secured to yoke 120 whereby lower outer tube member 210 is positioned over or inside upper component 125 of yoke 120 and a position-locking pin is placed through receiving hole 211 through the lower outer tube member 210 and receiving hole 126 through upper component 125, securing telescoping strut extension 200 to yoke 125 whereby telescoping extension strut 200 is preferably at a 45-degree angle to the ground. However the angle may vary based on the specific needs of the emergency rescue situation. Upper inner tube member 220 is extended in relation to the lower outer tube member 210 whereby telescoping extension strut 200 and the end fitting of the upper inner tube member 220 is positioned against the vehicle at about two-thirds the height of the vehicle thus creating a secured attachment point. Two-thirds of the height of the load is the preferred height so as to avoid the load tipping over upon Bi-pod rescue strut system 100, but the height the end fitting is positioned against the load may be any distance from one-half or above the height of the load.

Load tension strap is securely tied or otherwise coupled to support legs and is affixed to a chain connected to a vehicle on its side. The chain is wrapped around, passed through, or hooked to part of a lower point on the side of vehicle and then secured and tightened creating tension between the load tension strap, the chain, and the vehicle to prevent Bi-pod rescue strut system 100 from kicking out and further providing stability to Bi-pod rescue strut system 100. A foot tension strap is attached to distal ends of support legs 102*a* 102*b* to prevent support legs 102*a* 102*b* from spreading apart from one another. An extension tension strap is coupled to upper inner tube member 210, whereby the strap is lead down along telescopic strut member 200, below yoke 120, and coupled to the load tension strap to distribute stresses evenly throughout Bi-pod rescue strut system 100 and taking some of the burden of the stresses and load.

Figure 8:
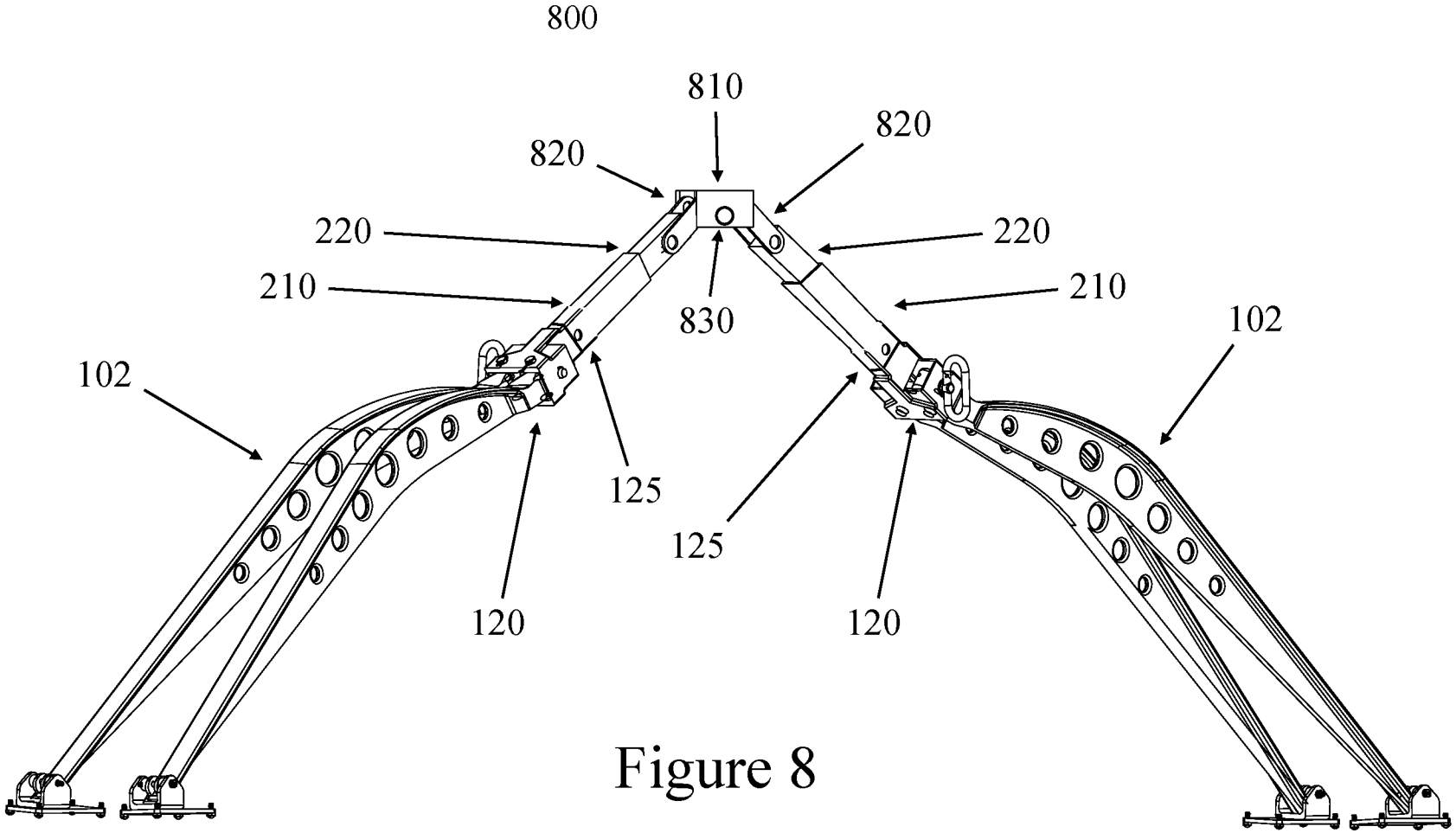
FIG. 8 illustrates a perspective view of an embodiment of a Bi-pod Rescue Strut System operating as a quad-pod for confined rescue.

Bi-pod rescue strut system 100 may have a number of other uses, such as to be used as a quad-pod whereby one or more Bi-pod rescue strut systems may be used to provide a support point for raising or lowering an object such as a rescue basket along a cliff, down a building, or out of a manhole. For example, FIG. 8 depicts another embodiment for the rescue strut. In this embodiment, a first Bi-pod rescue strut system and a second Bi-pod rescue strut system are coupled to a head 800 whereby the assembled quad-pod may be used to facilitate confined space rescue of a person or other object. The quad-pod head includes a base portion such as base portion 810 and one or more anchoring legs such as anchoring legs 820.

Anchoring 820 legs are attached to the base portion 810 whereby the anchoring legs may pivot about a pivot axis relative to the base portion 810. Anchoring legs 820 are adapted to either move jointly or independently of each other, and may be positioned in a variety of ways. For instance, anchoring legs 810 may be moveable towards and away from each other so as to be spread apart. Anchoring legs 810 have holes formed through them whereby when the anchoring legs are inserted into or fitted around upper inner tube member 220 of the first and second Bi-pod rescue strut system the holes through anchor legs 810 align with the holes through upper inner tube members 220. Position-locking pins may be placed to secure upper inner tube member 220 of the first Bi-pod rescue strut system and second Bi-pod rescue strut system to first and second anchoring legs 200. Base portion 810 of the head 810 may include one or more anchoring holes such as anchoring hole 830 to provide an anchoring point for support apparatuses such as a basket and pulley system. The base of the head may also include one or more stabilization holes to provide securing points for other stabilizing apparatuses such as straps, chains, or mechanisms.

In the preferred method of use anchoring legs 820 are coupled to the first and second rescue strut stabilization system and secured with position locking pins. Once upper inner tube members 220 are telescopically extended relative to the lower outer tube members 210, the support legs 102*a* 102*b* may be deployed and locked at a desired angle. The basket or other rescue apparatus is supported by the attachment point to the base of the head and may be moved from a position above a manhole through the space created between the first and second Bi-pod rescue strut system to down into the manhole without having to move the Bi-pod rescue strut system support legs. This provides an effective mechanism where the weight of the basket is supported by the rescue strut members as the rescue strut members remain firmly secured to the ground. The quad-pod may also be configured so that Bi-pod rescue strut systems are angled so that the basket can be lowered off of a cliff without moving the Bi-pod rescue strut system support legs.

In further embodiments, straps or other apparatuses such as strong rope, chain, or other type of tying members may be used to provide additional stabilization between support legs in a single Bi-pod rescue strut system as well as between Bi-pod rescue strut systems, to help prevent the support legs from separating from one another and so the quad-pod is stopped from moving during use.

In another non-limiting embodiment, Bi-pod rescue strut system 100 may be used to elevate a vehicle on its side by using two or more Bi-pod rescue strut systems positioned on opposite sides of the vehicle. In this embodiment, an extension tension strap is connected to the telescopic strut extension and carried down between the support legs and connected to a load tension strap, chains, or mechanism, used to couple the supports legs to the lower portion of a load, and tightened. The tightening of the extension tension strap and load tension strap produces a 5:1 vector mechanical advantage and also keeps the First Responder off the ground out of the way while operating a winch, come, or other apparatus with a ratchet strap or other device. The vector mechanical advantage may be multiplied by 10:1 if the connection is made by a pulley system connected to the Bi-pod rescue strut system.

Bi-pod rescue strut system 100 may also be used as a vertical column to provide a support for stabilizing a load directly above the Bi-pod rescue strut system 100. In this embodiment, the Bi-pod rescue strut system 100 is providing support to an overhead load such as a collapsing ceiling. Support legs 102*a* 102*b* may have been spread apart and locked in place in their deployed positions at the selected angle desired by the First Responder with "U" shaped mounting bracket 162 and base plate 163 of stabilizing feet 160*a* 160*b* rotated at angle with respect to support legs 102*a* 102*b* so that support legs 102*a* 102*b* and upper component 125 of yoke 120 are pointed at an upward vertical direction. Telescoping extension strut 200 is secured to yoke 120 whereby lower outer tube member 210 is positioned over or inside upper component 125 of yoke 120 and a position-locking pin is placed through receiving hole 211 through lower outer tube member 210 and receiving hole 126 through upper component 125 of yoke 120, whereby telescoping extension strut 200 is preferably at a 90-degree angle to the ground. Upper inner tube member 220 is extended in relation to lower outer tube member 210 whereby telescoping extension strut 200 and the end fitting of upper inner tube member 220 is positioned against the ceiling. A position-locking pin is placed through the hole of upper extendable inner tube 220 and corresponding lower outer tube 210 whereby Bi-pod rescue strut system 100 is supporting and stabilizing a load directly above the rescue strut.

Figure 9:
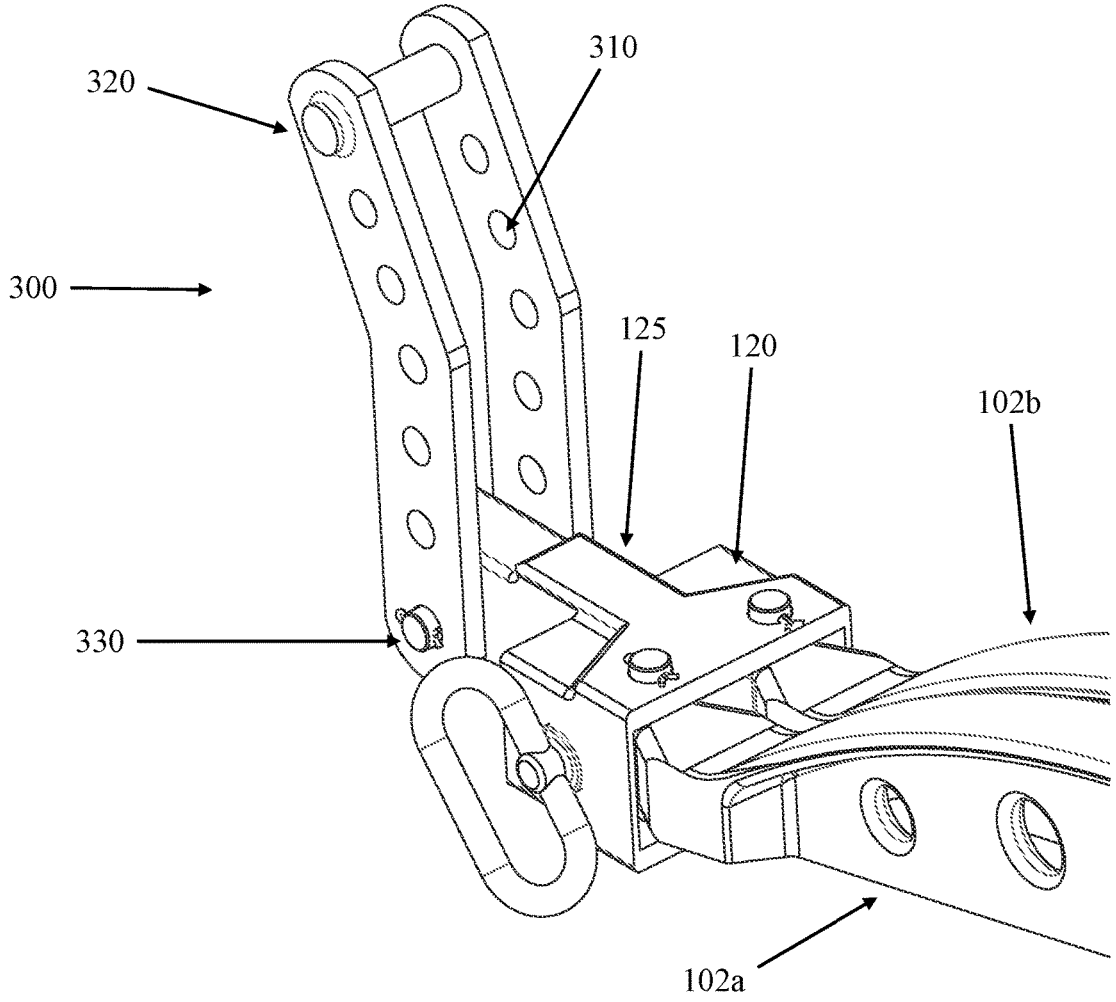
FIG. 9 illustrates a perspective view of the attachment link and yoke of the Bi-pod Rescue Strut System in the up position.

It is an intended objective of the present description to show that Bi-pod rescue strut system 100, in accordance with one or more embodiments, is extremely versatile and may have a variety of applications. Accordingly, a First Responder may couple upper component 125 of yoke 120 to an attachment link such as attachment link 300 to provide further uses and provide a connection to multiple devices, as depicted in FIG. 9. Attachment link 300 has a first and second member with an opening between the first and second member.

The first and second member, may include a number of slots such as slots 310 configured to receive pins such as pin 320 that extend through the first and second member and through the opening between them. In some embodiments, other members may connect the first and second member. The first and second member are connected to upper component 125 of yoke 120 by a position-locking pin such as position-locking pin 330 that extends through upper component 125 of yoke 120. Position-locking pin 330 may be removed to detach the attachment link 300 from upper component 125 of yoke 120. Attachment link 300 is configured to be removably connected to a jack, lever, fulcrum, or to other devices in order to assist in lifting, stabilizing, or moving the vehicle or the other objects. In further embodiments multiple pins may be used to connect the attachment link to the upper component of the yoke and to connect the attachment link to a jack, lever, fulcrum, or to other devices.

The Bi-pod rescue strut system may be coupled to a jack such as a HI-LIFT jack. For example, a position-locking pin may be used to couple attachment link to the jack. Afterwards, a First Responder may angle the stabilizing feet and slide the jack and the attached Bi-pod rescue strut system beneath an underside of an object. Alternatively, a First Responder may initially invert Bi-pod rescue strut system and angle the stabilizing feet such that support legs are flipped over whereby their top surfaces are touching the ground level and position Bi-pod rescue strut system beneath the object. Then, the First Responder may couple the jack to the inverted Bi-pod rescue strut system with a position-locking pin.

The First Responder may also operably couple a strap from the support legs to a base plate beneath the jack to provide additional sturdiness and stability when using the Bi-pod rescue strut system. This may be useful in scenarios whereby Bi-pod rescue strut system may be used for lifting a load onto an elevated location or lowering down the load from an elevated location, such as a loading dock or stairs. To do so, in one or more embodiments, the stabilizing feet of Bi-pod rescue strut system may be placed on the elevated location and the load may be placed on the support legs in an inverted position. When the jack has lifted or lowered the load, the load may simply be pushed off of support legs to its desired location.

In one non-limiting embodiment, Bi-pod rescue strut system 100 may be coupled to a lever such as lever 400. For example, a position-locking pin may be used to couple attachment link 300 to the lever 400. The lever 400 may be coupled to and balancing on fulcrum such as fulcrum 420. There are times where a First Responder of Bi-pod rescue strut system 100 may not be in possession or have easy access to the various specialized jacks useful in lifting vehicles or other objects so a lever or bar, disposed over a fulcrum may suffice to quickly and safely lift a vehicle or other object.

Figure 10:
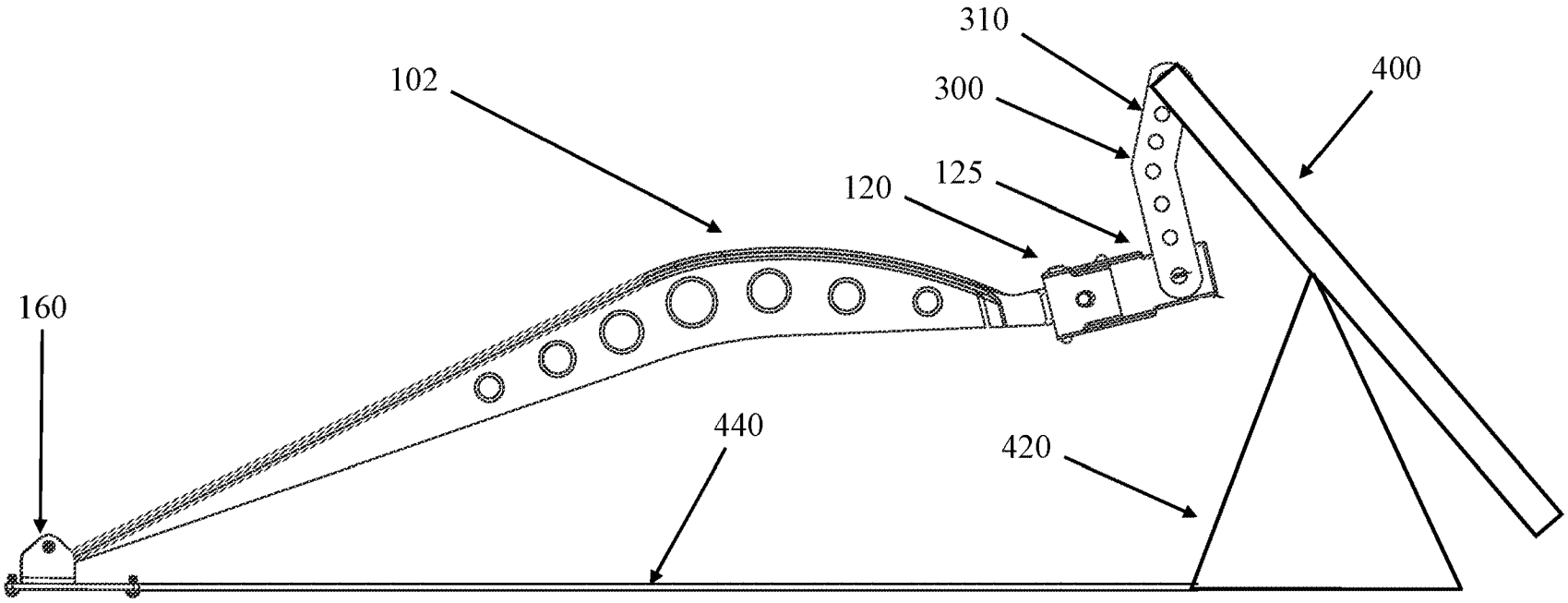
FIG. 10 illustrates a perspective view of an embodiment of a Bi-pod Rescue Strut System operating as a lifting device to lift a vehicle or other object.

In such a situation, Bi-pod rescue strut system 100 coupled to lever 400, disposed over fulcrum 420 may suffice to quickly and safely lift a vehicle or other object, as depicted in FIG. 10. Accordingly, a First Responder may couple Bi-pod rescue strut system 100 to lever 400 by coupling the attachment link 300 to the body of lever 400. Lever 400 may include a designated slot for inserting a position-locking pin, into a slot of lever 400 and also through designated slot 310 located on attachment link 300. A strap such as strap 440 may also be located on stabilizing feet 160 or on support legs 102 and may be configured to allow the First Responder to strap fulcrum 420 to Bi-pod rescue strut system 100 to prevent the base of Bi-pod rescue strut system 100 from kicking out.

Afterwards, the First Responder (with or without the assistance of other individuals) may determine a suitable location beneath a vehicle or other object for sliding Bi-pod rescue strut system 100 beneath the vehicle or other object. Then, the First Responder may apply force to the free end of lever 400 to cause Bi-pod rescue strut system 100 to raise the vehicle or other object such that support legs 102*a* 102*b* on Bi-pod rescue strut system 100 make contact with an underside of the vehicle or other object. If one applies sufficient force to the end of lever 400, the First Responder may be able to at least nominally and minimally raise the vehicle or other object to provide some space for one or more other First Responder to place one or more step chocks or other apparatuses underneath the vehicle to stabilize the vehicle.

Figure 11:
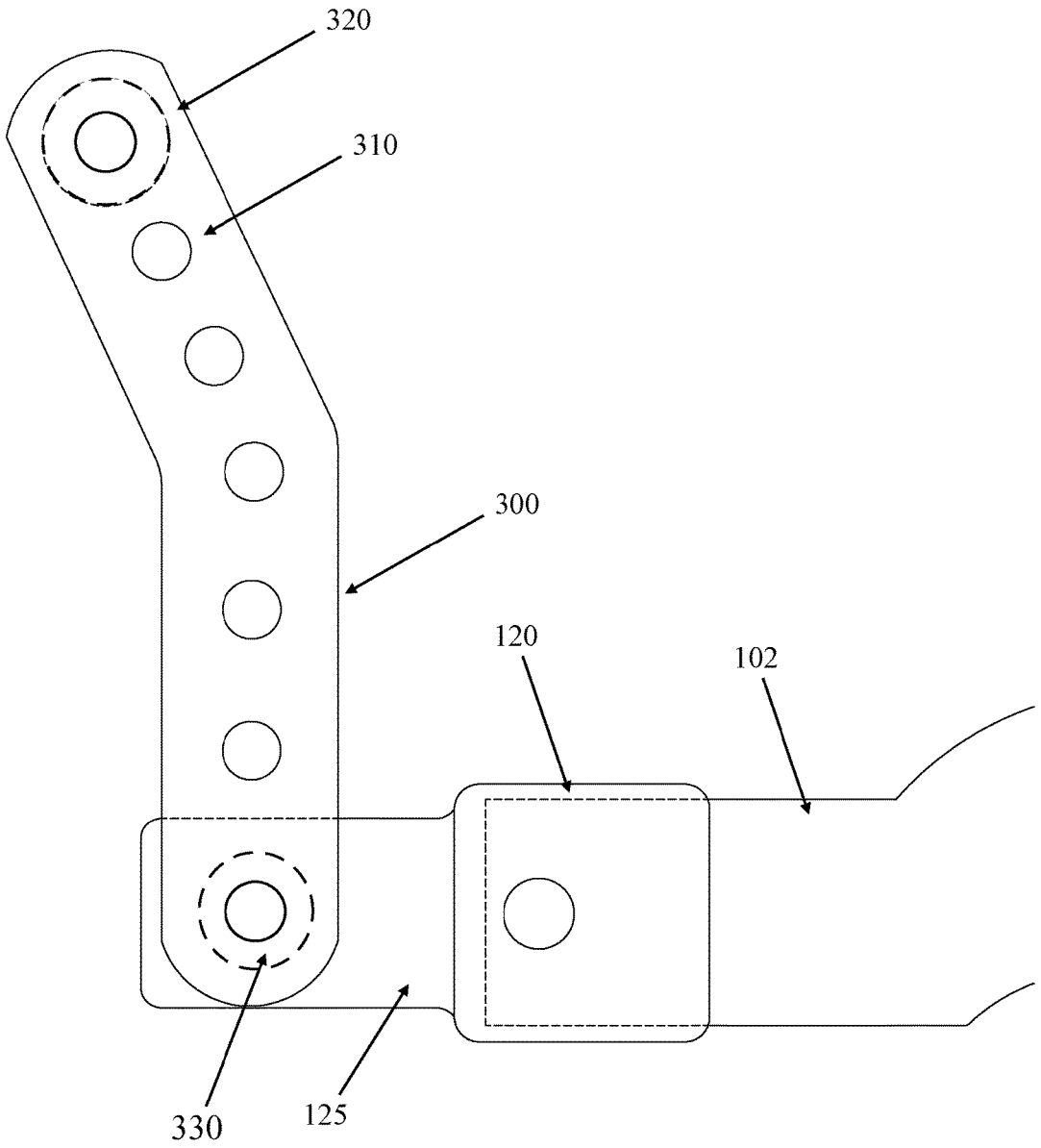
FIG. 11 illustrates a side view of the attachment link and yoke of the Bi-pod Rescue Strut System in the up position.

In some embodiments, attachment link 300 may be connected to Bi-pod rescue strut system 100 in the up-secured position as seen in FIG. 11. Bi-pod rescue strut system 100 is positioned beneath the vehicle or other object. Then, the First Responder may apply force to the free end of lever 400 to cause Bi-pod rescue strut system 100 to raise the vehicle or other object such that support legs 102*a* 102*b* on Bi-pod rescue strut system 100 make contact with an underside of the vehicle or other object. The vehicle then may be lifted to a certain height and one or more step chocks or other apparatuses may be positioned under the vehicle initially to assist the First Responders in lifting the vehicle.

Figure 12:
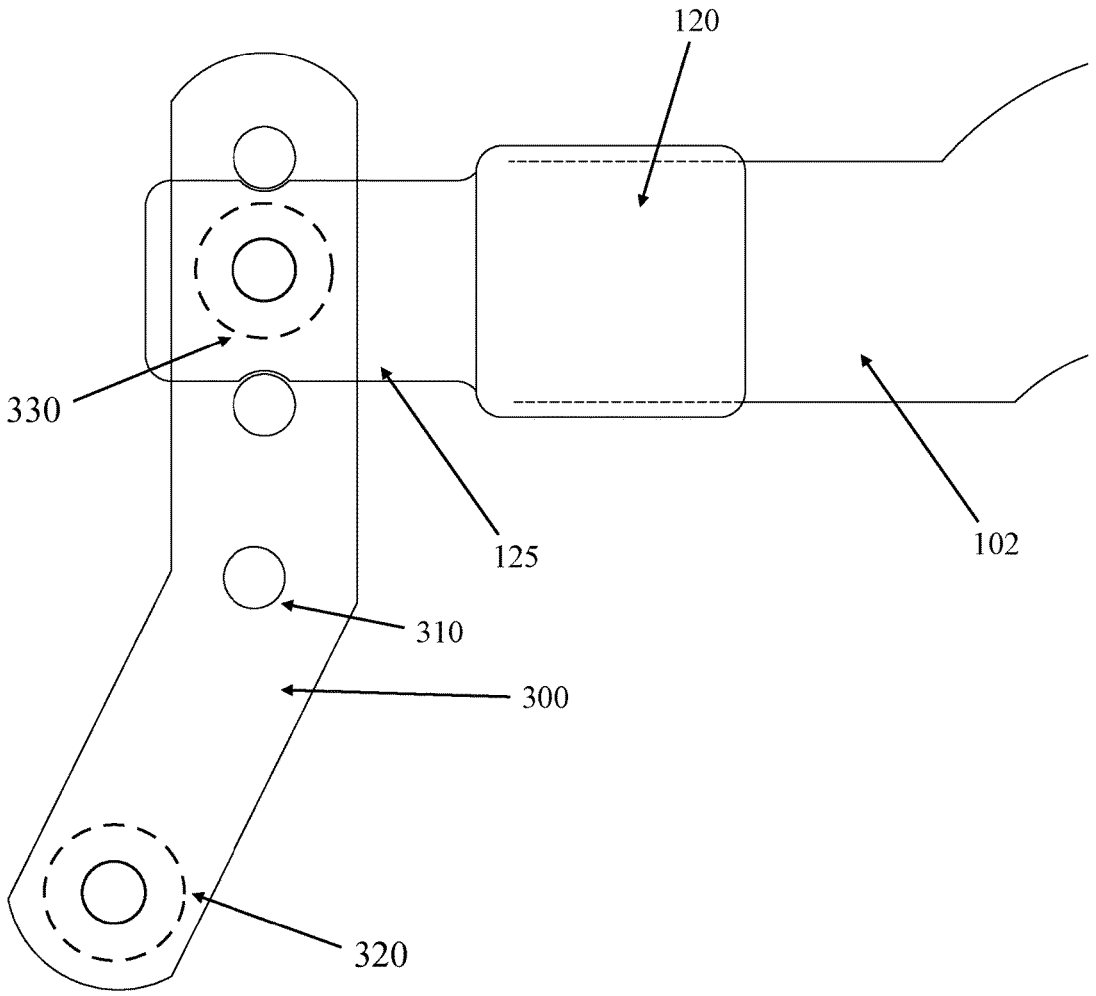
FIG. 12 illustrates a side view of the attachment link and yoke of the Bi-pod Rescue Strut System in the down position.

Once the vehicle is stabilized by the step chocks or other apparatuses, Bi-pod rescue strut system 100 may be temporarily removed and attachment link 300 may be connected to Bi-pod rescue strut system 100 in the down secured position as seen in FIG. 12. Bi-pod rescue strut system 100 is positioned beneath the vehicle or other object. Then, the First Responder may apply force to the free end of lever 400 to cause Bi-pod rescue strut system 100 to raise the vehicle or other object such that support legs 102*a* 102*b* on Bi-pod rescue strut system 100 make contact with an underside of the vehicle or other object. The vehicle or other object then may be lifted to a higher height and one or more step chocks or other apparatuses of higher elevation may be positioned under the vehicle or other object. This embodiment is useful particularly in emergency rescue operations where it is critical to access trapped individuals as quickly and as safely as possible.

The above-described Figures illustrate the architecture, functionality, and operation of possible implementations of the invention described in the present description according to various embodiments. The detailed description of the illustrative embodiments above is described in sufficient detail to enable those skilled in the art to practice the invention. To avoid unnecessary detail, the description may have omitted certain information known to those skilled in the art.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

What is claimed is:

1. A Bi-pod rescue strut system for vehicles or other object, comprising:

one or more stabilizing feet;

one or more support legs having a first end and second end, wherein each of the one or more stabilizing feet is attached to the first end of one of the one or more support legs;

a yoke, connected to the second end of the one or more support legs, the yoke having one or more engagement holes;

wherein each of the one or more support legs has an engagement hole at an angle through the support legs, wherein when the one or more support legs are rotated at an angle in relation to the yoke, the engagement hole in each of the one or more support legs aligns with the one or more engagement holes in the yoke, permitting a pin to be placed through the engagement hole in each of the one or more support legs and through the one or more engagement holes in the yoke, securing each of the one or more support legs at the angle in relation to the yoke.

2. The Bi-pod rescue strut system of claim 1, further comprising a telescoping strut extension, wherein the telescoping strut extension has a lower member and an upper extendable member, the lower member connected to the yoke, the lower member in slidable engagement with the upper extendable member, the upper extendable member configured to be positioned against a vehicle or other object to assist in stabilizing the vehicle or other object.

3. The Bi-pod rescue strut system of claim 2, wherein the lower member has one or more engagement holes at one or more positions and the upper extendable member has one or more engagement holes at one or more positions to permit locking of the upper extendable member in a telescoped position relative to the lower member.

4. The Bi-pod rescue strut system of claim 2, wherein the lower member is adapted to fit around an outer area of the upper extendable member.

5. The Bi-pod rescue strut system of claim 1, wherein the one or more support legs are elongated curvilinear members having a proximal end and a distal end, wherein each of the one or more support legs comprises:

a body having a bottom surface and a top surface, wherein the top surface has an upwardly angling portion and a downwardly angling portion, such that the top surface tapers upwardly at an angle to a highest point, and then tapers downwardly at an angle, such that the top surface and bottom surface meet at the distal end.

6. The Bi-pod rescue strut system of claim 1, wherein the one or more support legs are straight and flat rather than curved.

7. The Bi-pod rescue strut system of claim 2, wherein the telescoping strut extension is detachably coupled to the yoke.

8. The Bi-pod rescue strut system of claim 1, wherein each of the one or more stabilizing feet is pivotally connected to the first end of each of the one or more support legs, and wherein the one or more stabilizing feet rotate around the first end of the one or more support legs.

9. The Bi-pod rescue strut system of claim 1, wherein the lower member and upper extendable member are round or square.

10. The Bi-pod rescue strut system of claim 1, further comprising one or more straps having a first end and a second end.

11. The Bi-pod rescue strut system of claim 1, wherein each of the one or more support legs pivots about a single axis or the one or more support legs pivot about multiple axes.

12. A stand for confined space and remote rescues comprising:

one or more rescue struts, the one or more rescue struts having:

one or more stabilizing feet;

one or more support legs having a first end and a second end, wherein each of the one or more stabilizing feet is attached to the first end of the one or more support legs;

a yoke disposed at the second end of each support leg, wherein each of the one or more support legs is connected to the yoke at the second end of each of the one or more support legs, such that each of the one or more support legs rotates around the yoke, and a telescoping strut extension, wherein the telescoping strut extension has a lower member and an upper extendable member, the lower member connected to the yoke, the lower member in slidable engagement with the upper extendable member, the upper extendable member having a first end;

a body coupled for receiving the first end of the upper extendable member of each of the one or more rescue struts, wherein the upper extendable members pivot about a pivot axis relative to the body;

wherein each of the one or more support legs has an engagement hole at an angle through the one or more support legs, wherein when each of the support legs is rotated at an angle in relation to the yoke, the engagement holes in each of the one or more support legs aligns with one or more engagement holes in the yoke, permitting a pin to be placed through the engagement holes in each of the one or more support legs and through the one or more engagement holes in the yoke, securing each of the one or more support legs at the angle in relation to the yoke.

13. The stand for confined space and remote rescues of claim 12, further comprising the body having one or more anchoring holes, the one or more anchoring holes providing an anchoring point to accommodate a support apparatus such as a basket or other support apparatus using a pulley and cable, wherein the basket is movable without moving the one or more rescue struts.

14. The stand for confined space and remote rescues of claim 12, each of the one or more stabilizing feet is pivotally connected to the first end of each of the one or more support legs, wherein the one or more stabilizing feet rotate around the second end of the one or more support legs.

15. The stand for confined space and remote rescues of claim 12, wherein each of the support legs are elongated curvilinear members having a proximal end and a distal end, wherein each of the one or more support legs comprises:

a body having a bottom surface and a top surface, wherein the top surface has an upwardly angling portion and a downwardly angling portion, such that the top surface tapers upwardly at an angle to a highest point, and then tapers downwardly at an angle, such that the top surface and the bottom surface meet at the distal end of each of the one or more support legs.

16. The stand for confined space and remote rescues of claim 12, wherein the lower member has one or more engagement holes at one or more positions and the upper extendable member has one or more engagement holes at one or more positions to permit locking of the upper extendable member in a telescoped position relative to the lower member.

17. The stand for confined space and remote rescues of claim 12, wherein each of the one or more support legs pivots about a single axis or the one or more support legs pivot about multiple axes.

18. A method of using a Bi-pod rescue strut system for use in lifting a vehicle or other object, the method comprising:

(a) producing a Bi-pod rescue strut system, the Bi-pod rescue strut system comprising:

one or more stabilizing feet;

one or more support legs having a first end and second end, wherein each of the one or more stabilizing feet is attached to a first end of the one or more support legs;

a yoke disposed at the second end of each of the one or more support legs, wherein each of the one or more support legs is connected to the yoke at the second end of each of the one or more support legs; wherein each of the one or more support legs has an engagement hole at an angle through the one or more support legs, wherein when each of the one or more support legs are rotated at an angle in relation to the yoke, the engagement hole in each of the one or more support legs aligns with an engagement hole in the yoke, permitting a pin to be placed through the engagement hole in each of the one or more support legs and through engagement the hole in the yoke, securing each of the one or more support legs in relation to the yoke;

(b) connecting a link to the yoke, the link in a first position;

(c) connecting a lever to the link, the lever connected to and balancing on a fulcrum;

(d) positioning the one or more support legs beneath the vehicle or other object;

(e) applying a force to an end of the lever, causing the one or more support legs on the lifting device to make contact with an underside of the vehicle or other object and lift the vehicle or other object to a first height, wherein the vehicle or other object is stabilized by a step chock or apparatus.

* * * * *